United States Patent [19]

Farraj

[11] Patent Number: 4,877,248

[45] Date of Patent: Oct. 31, 1989

[54] AMUSEMENT DEVICE WITH PLAYING PIECES REARRANGABLE IN SLOTS

[76] Inventor: Hefetz Farraj, 8 Harakevet Street, Lod, Israel

[21] Appl. No.: 182,929

[22] Filed: Apr. 18, 1988

[30] Foreign Application Priority Data

Feb. 23, 1988 [IT] Italy ..... 85505

[51] Int. Cl.[4] ..... A63F 9/08

[52] U.S. Cl. ..... 273/153 S

[58] Field of Search ..... 273/153 S; 116/323

[56] References Cited

U.S. PATENT DOCUMENTS

| | | | |
|---|---|---|---|
| 524,703 | 8/1894 | Carter | 273/153 S |
| 631,737 | 8/1899 | Compton et al. | 273/153 S |
| 1,206,054 | 12/1916 | Trull | 273/153 S |
| 1,702,873 | 2/1929 | Kupfer | 116/323 |
| 3,706,457 | 12/1972 | Gonzales et al. | 273/153 S |
| 4,269,414 | 5/1981 | DeVos et al. | 273/153 S |

*Primary Examiner*—Anton O. Oechsle

*Attorney, Agent, or Firm*—Helfgott & Karas

[57] ABSTRACT

An amusement device includes a rigid plate provided with a plurality of elongated slots interconnected with each other, and a plurality of playing pieces different in shape and/or color. The playing pieces are freely slidable in the elongated slots and may be displaced from one slot to another.

18 Claims, 4 Drawing Sheets

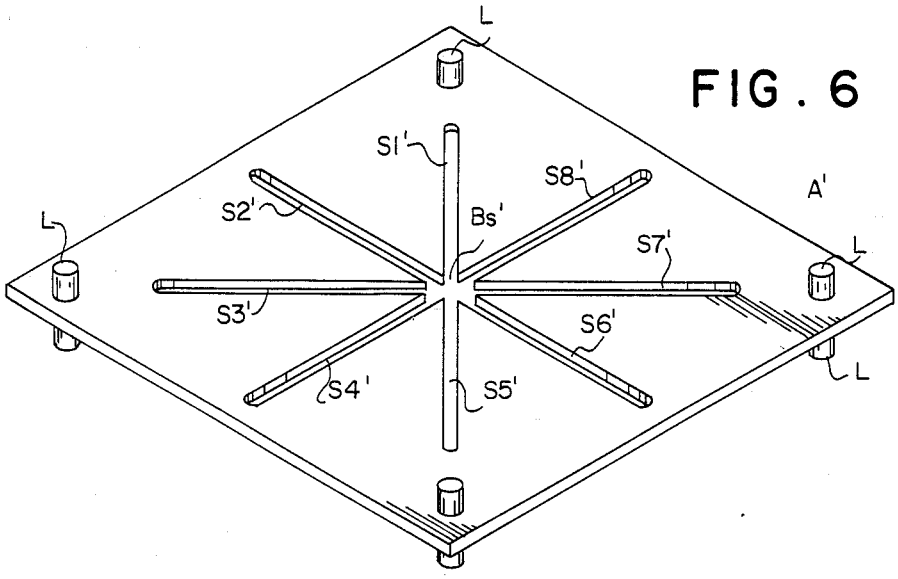
FIG. 6
FIG. 9
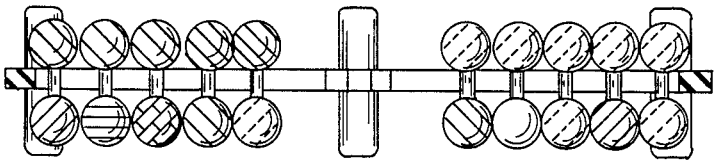
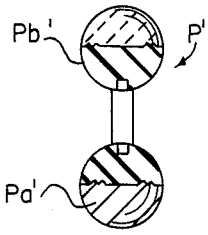
FIG. 10

AMUSEMENT DEVICE WITH PLAYING PIECES REARRANGABLE IN SLOTS

The present invention relates to an amusement and recreation device, or toy, of the type comprising a plurality of displaceable playing-pieces which are to be arranged in a certain order, requiring patience and skill on the part of the player (generally comparable to the famous "Hungarian Cube").

It is an inherent deficiency of toys of the type referred-to, that after having expended the amount of skill and time required to arrange the displaceable playing-pieces in the desired order or pattern, one has to manipulate most or all of the pieces into a disorderly pattern, to start a new play. Therefore, it is one of the major objects of the invention to provide a displaceable playing-piece toy that can be played over and over again without expending any effort to restart a new cycle of playing.

It is a further object of the invention to provide a toy of the type referred-to which may be produced at various levels of complexity and difficulty, to adapt the toy to different classes of players according to their intelligence, age and ability.

A further object of the invention is to provide a toy of attractive and handy construction.

Thus, according to the invention there is provided an amusement device comprising a rigid, double-sided surface, a series of elongated slots, each closed at one end, and a bridging slot which interconnects the other ends of the slots, forming a common passage thereamong, a plurality of playing-pieces each freely slidable along and manipulable from any elongated slot to any other elongated slot via the bridging slot, the playing-pieces constituting a number of groups, distinctive by features such as color or shape, corresponding to the number of the elongated slots.

The number of playing-pieces of each group is preferably such that when piled up, in its respective elongated slot, such slot becomes filled with the playing-pieces, from its closed end to the bridging slot, allowing, however, the passage of a playing-piece across the junction between the respective elongated slot and the bridging slot.

Alternatively, the number of playing-pieces of one group exceeds the number of such pieces of each of the other groups, so that the passage of a playing-piece of any of the other groups, across the junction of the respective slot of the first mentioned group, is blocked.

The slots formed in the base surface of the device may extend parallel one to the other, with the bridging slot extending in a cross-direction, or, according to another embodiment of the invention, the slots extend in directions radiating from a central location of the surface.

The playing-pieces may be formed as a pair of headed, spherical portions, connected by a stem which passes through the respective slots.

By having different distinctive features of the playing-piece heads appearing at either side of the surface, it is achieved, that by the successfully completed arrangement of the pieces at one side of the surface, i.e. the orderly arrangement of the playing-pieces according to their respective distinctive features,—the arrangement of the playing-pieces at the other side of the surface becomes automatically mixed so that play may be immediately started again, by just turning the board upside-down.

These and additional advantages and constructional features of the amusement device according to the present invention will be appreciated in the light of the following description of two preferred embodiments of the invention, given by way of example only, with reference to the accompanying drawings, wherein FIG. 1 is a three dimensional representation of a base board of the device according to the invention without the playing-pieces mounted thereon;

FIG. 6 shows a board of another configuration of the device according to the present invention;

FIG. 9 is a cross-section of the board of FIG. 7; and

FIG. 10 is a partly cross-sectional view of a playing-piece for use in the device according to the second embodiment of the invention.

As showed in FIGS. 1–5 the amusement device according to the invention is essentially comprised of a board A, which is formed with a series of parallel elongated slots S1, S2, S3, . . . , S7. The slots S are closed or discontinued at their lower ends, while their upper ends are interconnected by a bridging slot designated BS, thereby forming a plurality of junctions J1, J2, J3, . . . , J7.

A plurality of playing-pieces, generally designated P, are mounted within the slots S (and BS—see below) on the board so as to be slidably displaceable therealong. Preferably, the playing-pieces are of double-head construction, namely having oppositely mounted spherical portions Pa and Pb, connected by a stem T. The connection is made by press-fit snap action, cementing, and the like, after the stem is passed through the slot. Heads Pa and Pb of every piece P bears distinctive features thereon such as color, shape or indicia applied thereto, being of different character relative one to the other.

Figure 1:
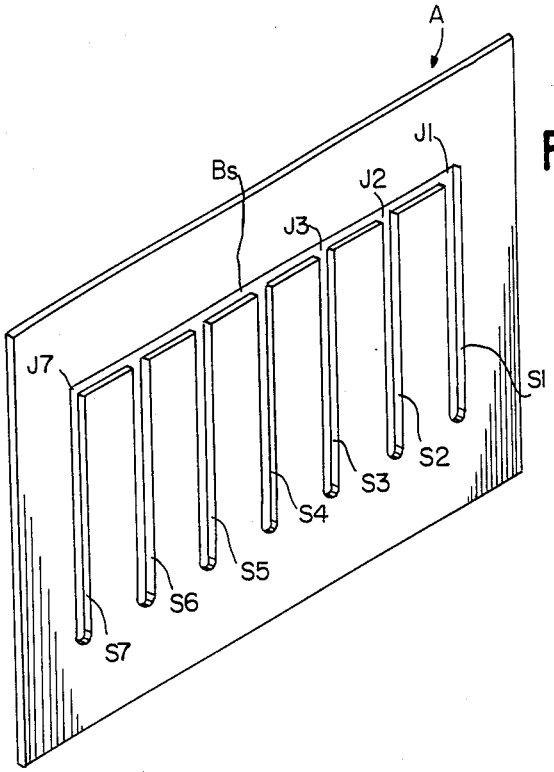
Figure 5:
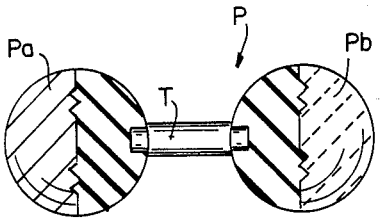
FIG. 5 is a partly cross-sectional view of a playing-piece used in the present embodiment of the invention.
Figure 4:
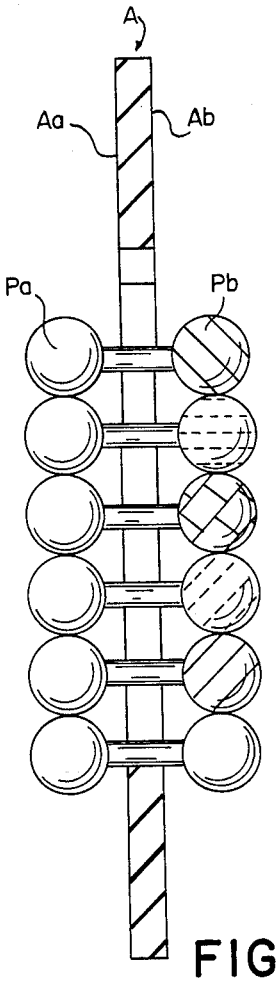
FIG. 4 is a sectional view showing the mounting of the playing-pieces within their respective slots.
Figure 2:
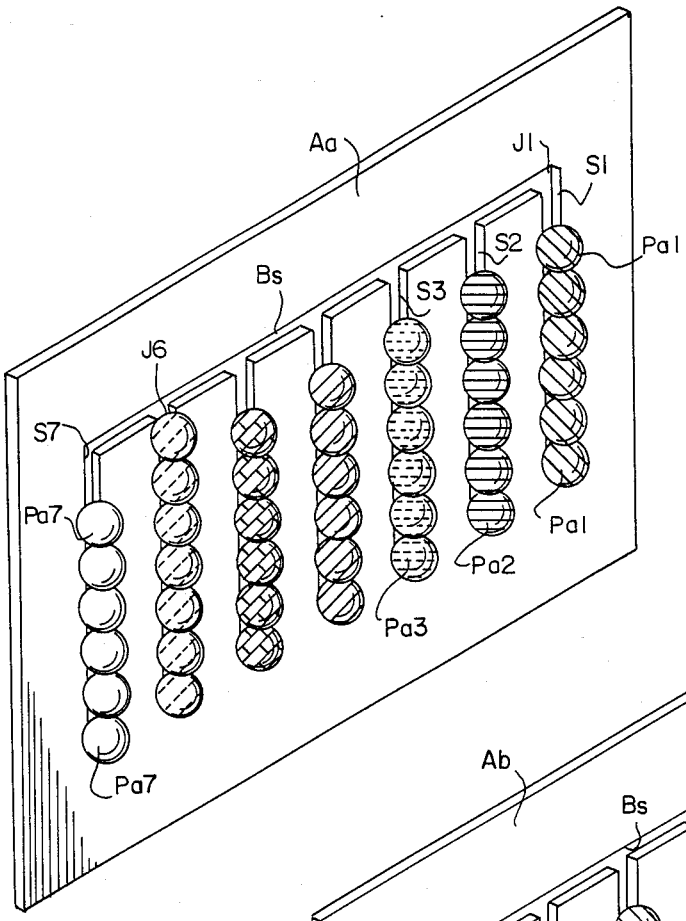
FIG. 2 shows the completed device with the playing-pieces mounted thereon in an orderly pattern.

In the present example, there are provided seven different groups of playing-pieces P, each group of portions Pa and Pb, respectively, having a common distinctive feature. However, the distinctive feature (e.g. the color) of the portions Pa and Pb of any given playing-piece is never the same. By skillful maneavering, the playing-pieces can be arranged as shown in FIG. 2, namely in an orderly pattern where all the Pa heads are arranged, bearing an identical color, along each one of the slots S1 through S7 at one side of the board A. This arrangement represents the goal or the achievement to be accomplished by the player at upon completion of every playing cycle, as will be explained further below.

Figure 3:
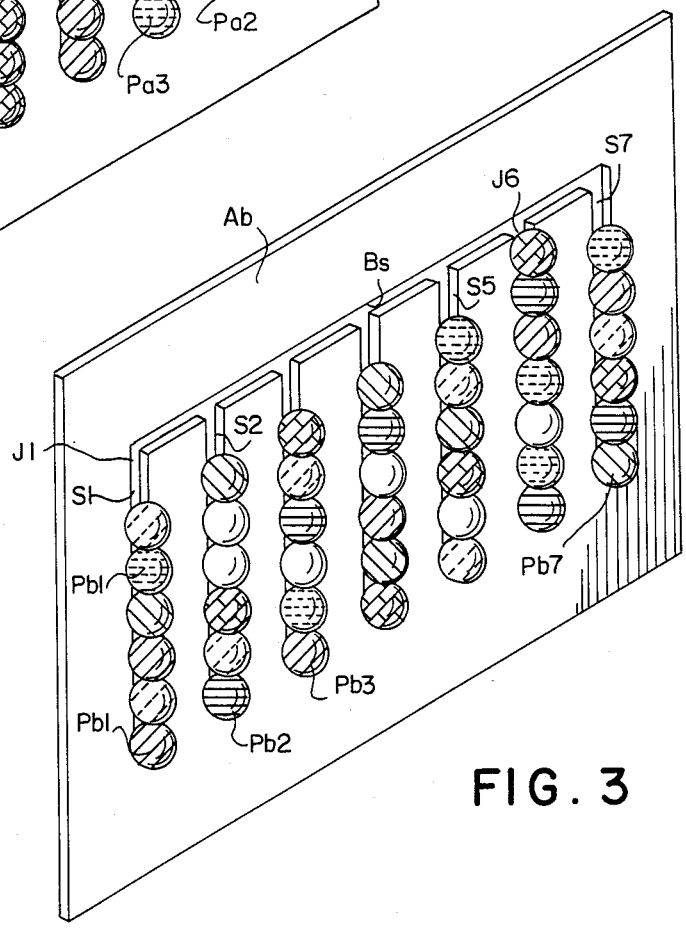
FIG. 3 shows the device of FIG. 2 from its reverse side, wherein the playing-pieces became arranged in a scrambled pattern.
Figure 7:
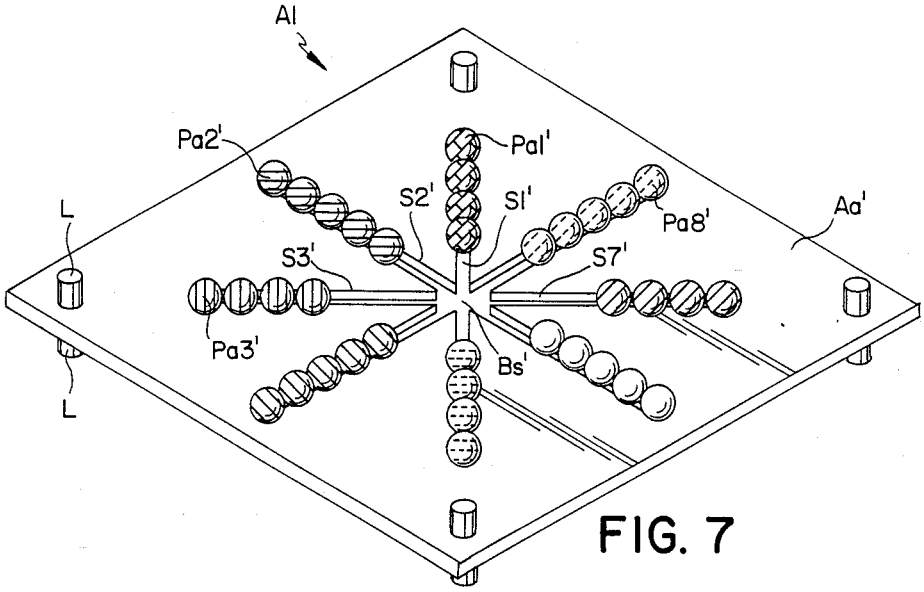
FIGS. 7–8 show one, arranged side and the reverse, scrambled side of the second embodiment of the device.
Figure 8:
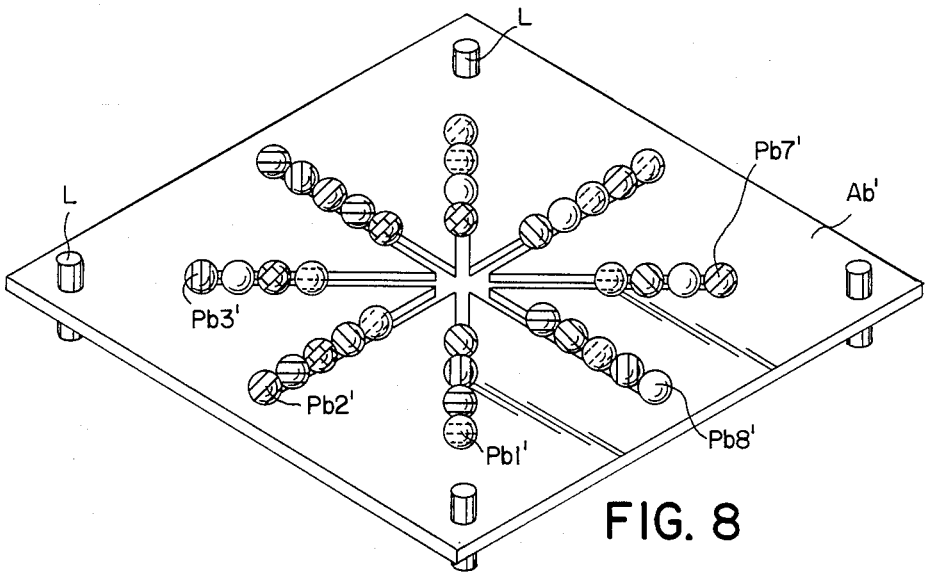

It will be readily understood that the very arrangement of the playing-pieces in an orderly manner, as seen in FIG. 2, will result in the disorderly arrangement at the opposite side of the board A, as represented in FIG. 3.

It will be further noted from FIGS. 2 and 3, that one of the slots—in the described example—comprise seven playing-pieces—rather than six in each of the other slots. Therefore, the respective junction J6 is blocked against the crossing therethrough of any other playing-piece in either direction, such as from slot S6 to slot S5, or vice versa. This is an optional feature which can be used for rendering the arrangement more challenging, i.e. for devices suitable for more advanced and experienced players.

Playing the toy is performed by systematically displacing the playing-pieces from one slot to another, via the respective junctions, from a random arrangement (FIG. 3) to the ultimate, ordered pattern showed in FIG. 2. It is the mission of the player to discover the systematic step-by-step progress, which must be strictly maintained, throughout the whole game; any error or deviation from the correct sequence will require the player to move back into a previous starting position, before making further progress.

Once completing the game and achieving its object by arranging the playing-pieces in the required order, a new game can be immediately started by just turning the board A to its other side.

The configuration of the toy according to FIGS. 6–10 will be now self explanatory. Hence, board A', having two sides Aa' and Ab', is provided with a plurality of slots S1', S2', . . . , S8'. The slots radiate from the center of the board A', forming at the center a bridging slot or zone designated BS'. The construction and arrangement of playing-pieces A' are analogous to those of the preceeding embodiment. Thus, eight groups of playing-pieces, with head portions Pa1', Pa2', . . . , Pa3' appear at one side Aa' of the board A', and the associated, differently-featured series of heads Pb' appear at the other side thereof. Preferably, the numbers of the pieces alternate regarding every pair of adjacent slots (four and five, respectively).

The manner of playing the toy follows exactly the same lines as before-described, except that the manipulation of the playing-pieces is accomplished by passing through the central bridging slot BS'.

Once the first side of the board has been properly arranged, it can be turned upside down and the play re-commenced without the nuisance of rearranging the playing-pieces, at random.

Legs L are provided for conveniently placing the board face-up or face-down, at will.

The invention thus provides a novel skill and patience game, which can take many forms and different levels of difficulty, to suit various age-levels, beginning at kindergarten level and upwards, by simple and low-cost means. Trial-runs with the new toy have shown that, with respect to the first embodiment hereinabove described, it would take, and adult player, about twenty minutes, on the average, to complete one playing cycle.

Those skilled in the art will readily understand that various changes, modifications and variations may be applied to the design and practice of the invention without departing from its scope as defined in and by the appended claims.

I claim:

1. An amusement device comprising a rigid, double-sided surface, a series of elongated slots, each closed at one end, and a bridging slot which interconnects the other ends of the slots, forming a common passage thereamong, a plurality of playing-pieces each freely slidable along and manipulable from any elongated slot to any other elongated slot via the bridging slot, the playing-pieces constituting a number of groups carrying thereon distinctive features including at least one of color and shape, the number of said groups corresponding to the number of the elongated slots, the number of playing-pieces of one of said groups being such that the passage of playing-pieces of other groups across a junction of the respective slot and the bridging slot is blocked when all of the playing pieces in said one group are disposed in said respective slot, each playing-piece comprising two opposite heads and a stem connecting said opposite heads to each other and passing through the respective slot from one side of the rigid board to the other side thereof.

2. The device as claimed in claim 1 wherein the number of playing-pieces of one group exceeds the number of the pieces of the remaining groups.

3. The device as claimed in claim 1 wherein, with respect to each group, each head, bears a distinctive feature different from that of its corresponding head.

4. The device as claimed in claim 3 wherein the heads are spherical.

5. The device as claimed in claim 1 wherein the elongated slots extend parallel to each other, the bridging slot extending in a crossing direction.

6. The device as claimed in claim 5 wherein all the elongated slots are of the same length.

7. The device as claimed in claim 1 wherein the elongated slots extend in directions radiating from a central location of the surface.

8. The device as claimed in claim 7 wherein all the elongated slots are of the same length.

9. An amusement device comprising a rigid flat board having a front side and a reverse side and including a series of elongated slots, each closed at one end, and a bridging slot which interconnects the other ends of the slots, forming a common passage thereamong; and a plurality of playing-pieces each freely slidable along and manipulable from any elongated slot to any other elongated slot via the bridging slot, the playing-pieces constituting a number of groups carrying thereon distinctive features including a least one of color and shape, the number of groups corresponding to the number of the elongated slots, each playing-piece having two opposite heads connected to each other and of which one head is exposed on said front side and the other head is exposed on said reverse side, said two opposite heads each carrying thereon a distinctive feature different from that of the opposite head with respect to each group so that when said one of said front and reverse sides is completed to arrange said groups in a uniform pattern the groups of the playing-pieces on the other of said front and reverse sides are arranged at random whereby a game can be re-started by merely reversing said board without reshuffling the playing-pieces on said one side, wherein the number of playing-pieces of one group exceeds the number of the pieces of the remaining groups.

10. The device as claimed in claim 9, wherein the number of the playing-pieces of each group is such that when piled up in its respective elongated slot, such slot becomes substantially filled with the playing-pieces, from its closed end to the bridging slot, allowing, however, the passage of a playing-piece across a junction between the respective elongated slot and the bridging slot.

11. The device as claimed in claim 9, wherein the number of playing-pieces of said one group is such that the passage of playing-pieces of other groups across a junction of the respective slot and the bridging slot is blocked when all of the playing-pieces in said one group are disposed in said respective slot.

12. The device as claimed in claim 9, wherein each playing-piece further comprises a stem connecting said opposite heads to each other and passing through the respective slot from one side of the rigid board to the other side thereof.

13. The device as claimed in claim 9, wherein the heads are spherical.

14. The device as claimed in claim 9, wherein the elongated slots extend parallel to each other, the bridging slot extending in a crossing direction relative to the elongated slots.

15. The device as claimed in claim 14, wherein all the elongated slots are of the same length.

16. The device as claimed in claim 9, wherein the elongated slots extend in directions radiating from a central location of the surface.

17. The device as claimed in claim 16, wherein all the elongated slots are of the same length.

18. An amusement device comprising a rigid, double-sided surface, a series of elongated slots, each closed at one end, and a bridging slot which interconnects the other ends of the slots, forming a common passage thereamong, a plurality of playing-pieces each freely slidable along and manipulable from any elongated slot to any other elongated slot via the bridging slot, the playing-pieces constituting a number of groups carrying thereon distinctive features including at least one of color and shape, the number of said groups corresponding to the number of the elongated slots, the number of playing-pieces of one of said groups being such that the passage of playing-pieces of other groups across a junction of the respective slot and the bridging slot is blocked when all of the playing-pieces in said one group are disposed in said respective slot, and wherein the number of playing-pieces of one group exceeds the number of the pieces in the remaining groups.

* * * * *